US008083477B2

(12) United States Patent
Hwang et al.

(10) Patent No.: US 8,083,477 B2
(45) Date of Patent: Dec. 27, 2011

(54) CENTRIFUGAL FAN

(75) Inventors: Ching-Bai Hwang, Taipei Hsien (TW); Zhi-Hui Zhao, Shenzhen (CN)

(73) Assignees: Furui Precise Component (Kunshan) Co., Ltd., KunShan, Jiangsu Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 571 days.

(21) Appl. No.: 12/328,782

(22) Filed: Dec. 5, 2008

(65) Prior Publication Data

US 2010/0040456 A1 Feb. 18, 2010

(30) Foreign Application Priority Data

Aug. 13, 2008 (CN) ..... 2008 1 0303725

(51) Int. Cl.
*F04D 29/44* (2006.01)
*F04D 29/54* (2006.01)

(52) U.S. Cl. ..... 415/206; 415/119

(58) Field of Classification Search ..... 415/119, 415/206, 213.1, 204, 208.1
See application file for complete search history.

(56) References Cited

U.S. PATENT DOCUMENTS

| | | | | |
|---|---|---|---|---|
| 3,695,775 | A * | 10/1972 | Zenkner | 415/53.1 |
| 5,108,833 | A * | 4/1992 | Noguchi et al. | 428/310.5 |
| 5,110,258 | A * | 5/1992 | Morinushi et al. | 415/119 |
| 5,997,246 | A * | 12/1999 | Humbad | 415/119 |
| 6,463,230 | B1 * | 10/2002 | Wargo | 399/92 |
| 7,210,903 | B2 * | 5/2007 | Lyons | 415/204 |
| 2008/0107523 | A1 * | 5/2008 | Chen et al. | 415/206 |

* cited by examiner

*Primary Examiner* — Caridad Everhart
(74) *Attorney, Agent, or Firm* — Altis Law Group, Inc.

(57) ABSTRACT

A centrifugal fan includes a plurality of blades, a casing and a tongue. The casing includes a base plate perpendicular to a rotation axis of the blades and a sidewall extending upwardly from the base plate. The base plate and the sidewall cooperatively define a space for receiving the blades therein. The sidewall defines an opening in one side for functioning as an air outlet. An air channel is defined between outmost ends of the blades and the sidewall. The tongue is detachably mounted to one end of the sidewall adjacent to the air outlet. The tongue includes a guiding surface protruding towards the outmost ends of the blades. The tongues is provided for lowering a noise level of the centrifugal fan during operation.

14 Claims, 7 Drawing Sheets

CENTRIFUGAL FAN

BACKGROUND

1. Technical Field

The disclosure relates to centrifugal fans, and particularly to a centrifugal fan having a low noise during operation thereof.

2. Description of Related Art

With continuing development of the electronic technology, electronic packages such as CPUs are generating more and more heat which is required to be dissipated immediately. Cooling fans are commonly used in combination with heat sinks for cooling the CPUs and other electronic products. Since most of electronic systems that contain electronic components therein such as laptop computers, or notebook computers do not have enough space therein, a centrifugal fan which requires only a small space for installation is generally used.

Referring to FIG. 7, the centrifugal fan typically includes a casing 101 and a plurality of blades 103 received in the casing 101. The casing 101 has a bottom wall 102 and a volute sidewall 104 defining an outlet 105 at one side thereof. An inner surface of the sidewall 104 is perpendicular to the bottom wall 102 of the casing 101. A volute channel 106 is formed between outmost ends of the blades 103 and the inner surface of the sidewall 104.

When the flow generated by the blades 103 is blowing on different points of the inner surface of the sidewall 104 adjacent the outlet 105, each blown point generates a narrow band noise. The narrow band noise generated at each point of sidewall 104 adjacent the outlet 105 occurs at substantially the same time and has substantially the same frequency. According to the superposition principle, these narrow band noises are superposed together to generate a noise with a large amplitude. Therefore, the noise could be too large to be bearable.

It is thus desirable to provide a centrifugal fan which can overcome the described limitations.

SUMMARY

According to an exemplary embodiment, a centrifugal fan includes a plurality of blades, a casing and a tongue. The casing includes a base plate perpendicular to a rotation axis of the blades and a sidewall extending upwardly from the base plate. The base plate and the sidewall cooperatively define a space for receiving the blades therein. The sidewall defines an opening in one side for functioning as an air outlet. An air channel is defined between outmost ends of the blades and the sidewall. The tongue is detachably mounted to one end of the sidewall adjacent to the air outlet. The tongue includes a guiding surface protruding towards the outmost ends of the blades. The tongue is made of sound absorbing material.

Other advantages and novel features of the present invention will become more apparent from the following detailed description of embodiment when taken in conjunction with the accompanying drawings.

DETAILED DESCRIPTION OF THE EMBODIMENTS

Reference will now be made to the drawings to describe the various present embodiments in detail.

Figure 1:
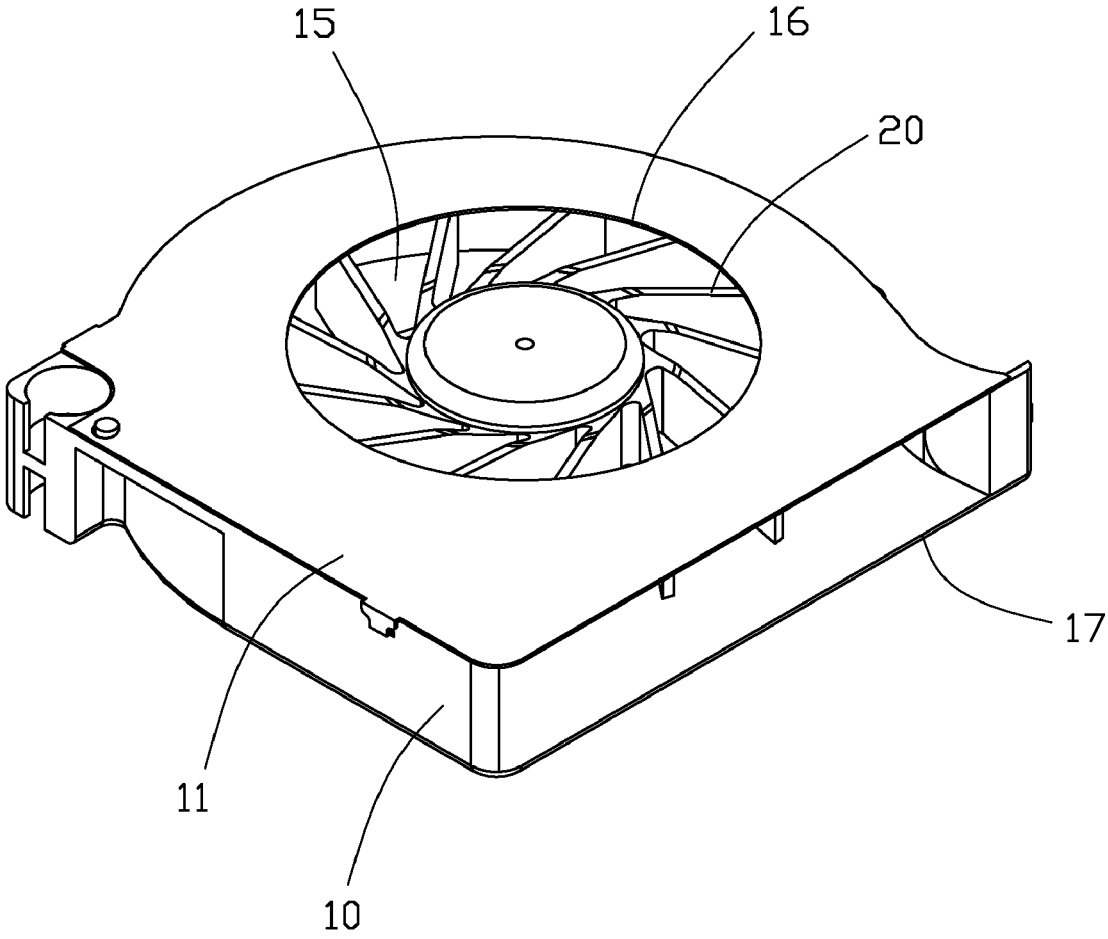
FIG. 1 is an assembled, isometric view of a centrifugal fan in accordance with a first embodiment.

Referring to FIG. 1, the centrifugal fan includes a casing 10, a cover 11 attached to the casing 10 with an inner space 15 formed therebetween, and a plurality of blades 20 rotatably received in the inner space 15. In this embodiment, the blades 20 rotate around an axis X-X along a counterclockwise direction as viewed from FIG. 2.

Figure 2:
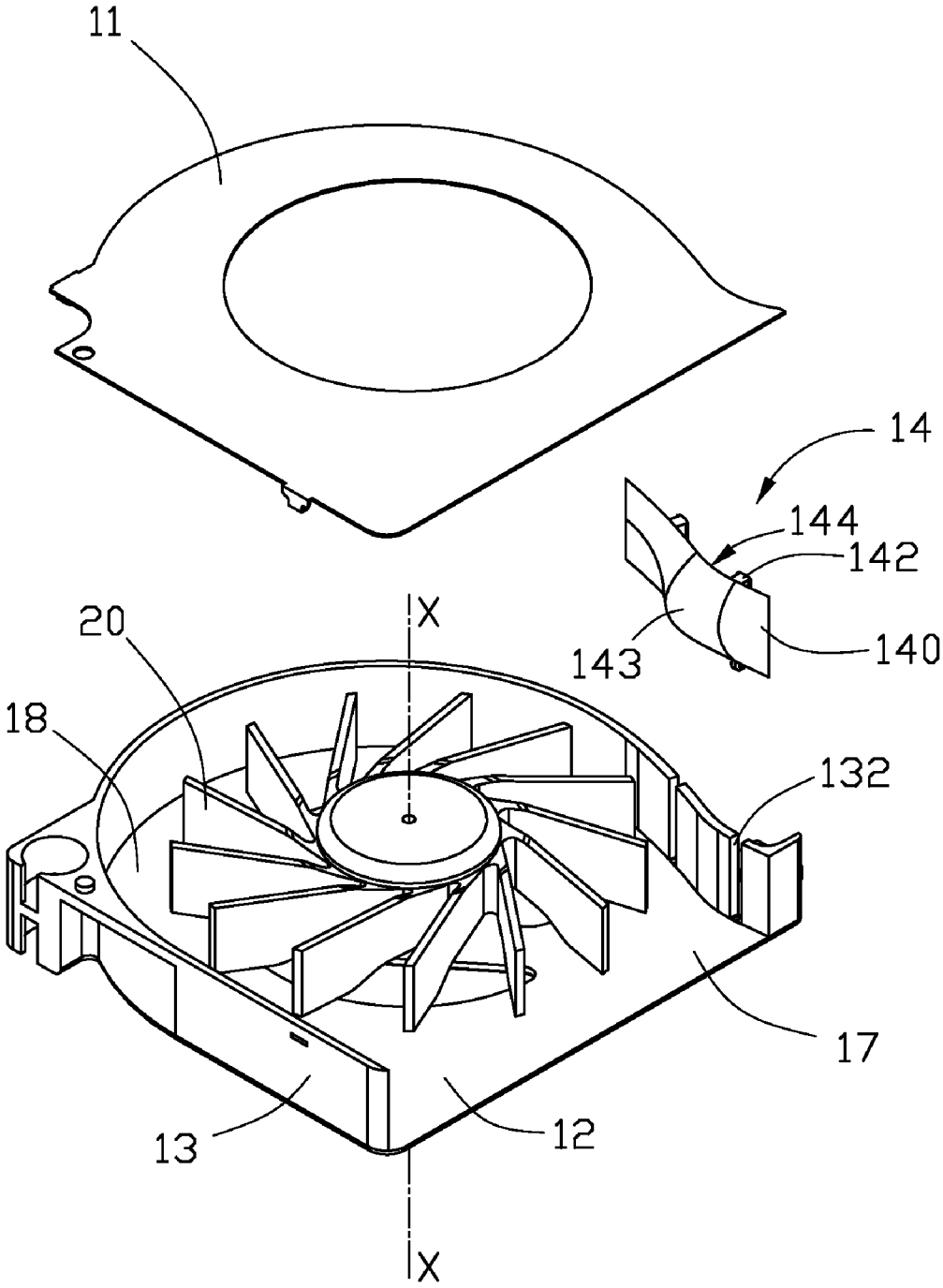
FIG. 2 is an exploded view of the centrifugal fan of FIG. 1.

The cover 11 defines a through hole therein functioning as an air inlet 16 of the centrifugal fan. Referring to FIG. 2, the casing 10 includes a flat base plate 12 perpendicular to the rotation axis X-X of the blades 20, a volute sidewall 13 extending upwardly and perpendicularly from an outer periphery of the base plate 12, and a tongue 14 attached to an inner surface of the sidewall 13. A volute air channel 18 is formed between outmost ends of the blades 20 and the inner surface of the sidewall 13. The sidewall 13 defines an opening in a right side thereof functioning as an air outlet 17 of the centrifugal fan. A first locking unit includes two rectangular grooves 132 being defined in a rear side of the sidewall 13 adjacent to the air outlet 17 as viewed in FIG. 2. The two grooves 132 are parallel to each other. Each of the grooves 132 extends along a longitudinal direction through the base plate 12 of the casing 10.

Figure 3:
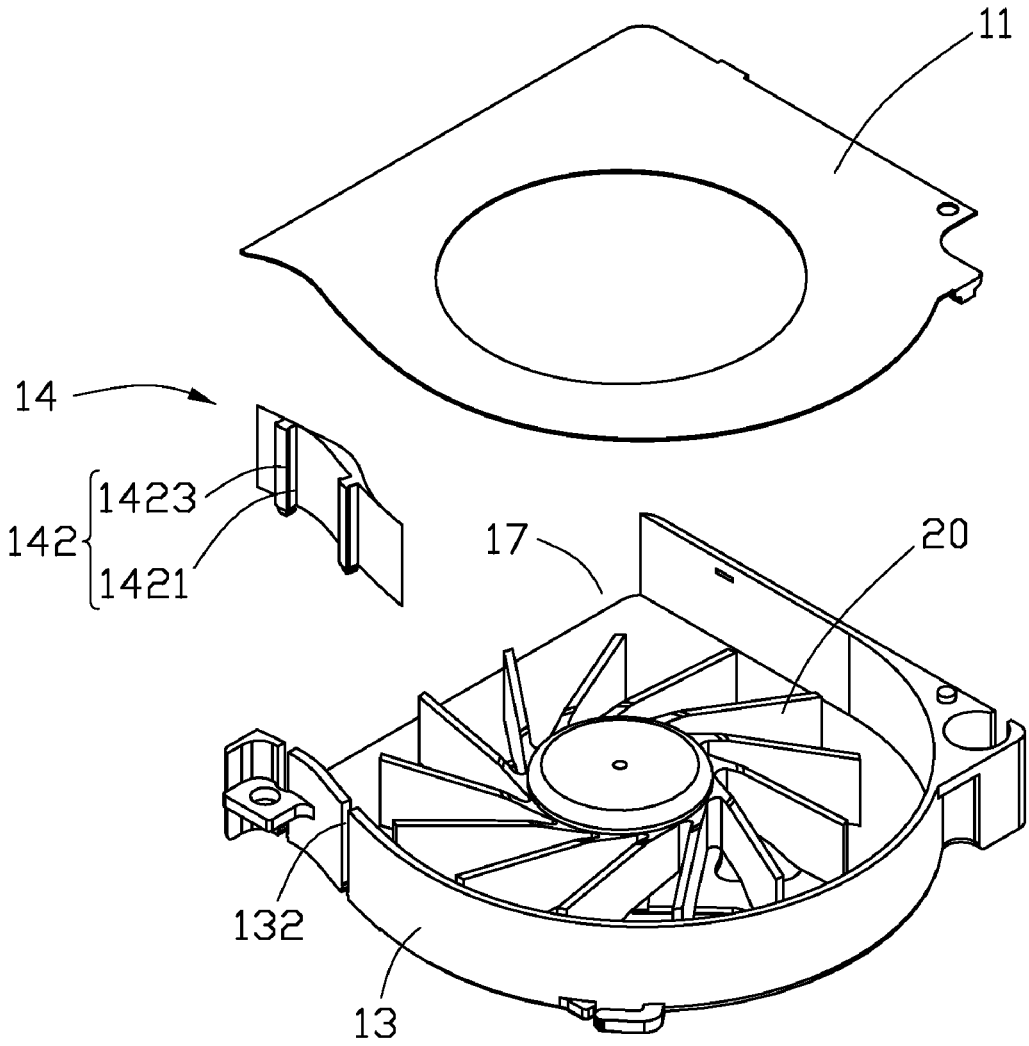
FIG. 3 is a view similar to FIG. 2, but shown from a different aspect.

The tongue 14 is made of porous, acoustic absorbing material, such as foamed plastic, glass wool or fibers. Referring to FIG. 3, the tongue 14 includes an elongated body 140 and a second locking unit. The body 140 has a curved guiding surface 143 and an opposite connecting surface 144. The connecting surface 144 of the body 140 is matched with a portion of the inner surface of the sidewall 13 at the first locking unit. The second locking unit includes two mounting columns 142 formed on the connecting surface 144 of the body 140. Each mounting column 142 includes a rectangular pole portion 1421 extending along a height direction of the body 140, and a cap portion 1423 formed on a distal side of the pole portion 1421 away from the connecting surface 144. The pole portions 1421 are parallel to each other. Each of the pole portions 1421 has a shape and size substantially equal to those of each of the grooves 132 of the sidewall 13; thus, the pole portions 1421 can be fittingly received in the grooves 132, respectively. The cap portions 1423 also extend along the height direction of the body 140.

Figure 4:
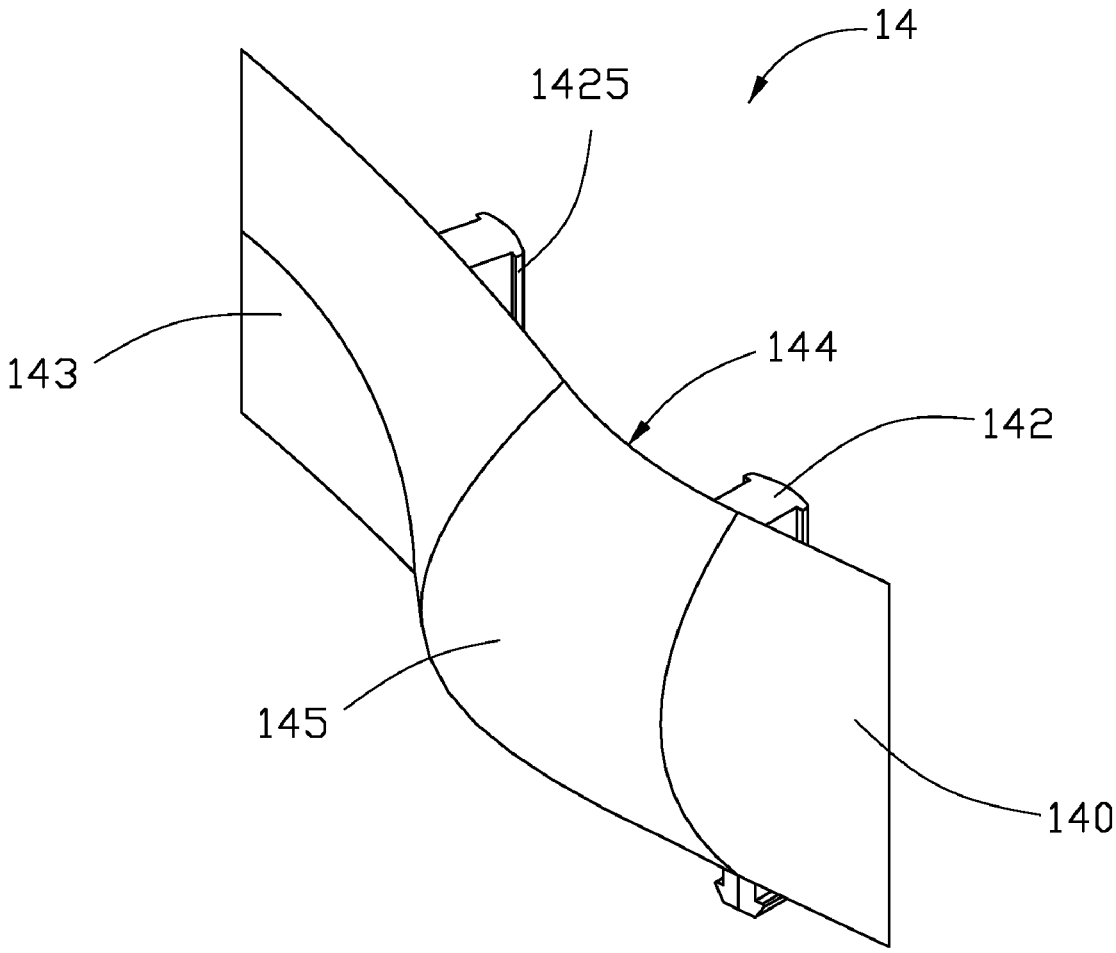
FIG. 4 is an enlarged view of a tongue of the centrifugal fan of FIG. 2.

Each of the cap portions 1423 has a width slightly larger than that of each of the pole portions 1421, which makes a cross-section of each of the mounting columns 142 approximately T-shaped. Referring also to FIG. 4, a pressing surface 1425 parallel to the connecting surface 144 of the body 140 is formed between the cap portion 1423 and the pole portion 1421 of each mounting column 142. The connecting surface 144 of the tongue 14 tightly contacts the inner surface of the sidewall 13 after the tongue 14 and the sidewall 13 are assembled together.

The guiding surface 143 is a convex surface, and protrudes outwardly from the connecting surface 144 towards the outmost ends of the blades 20. A crested bulge 145 is formed on a middle portion of the guiding surface 143. A thickness of the body 140 decreases gradually from the bulge 145 to two opposite ends (i.e., inner end in the space 15 and outer end adjacent to the air outlet 17) of the body 140 along a lengthwise direction of the body 140, and decreases gradually from the bulge 145 to top and bottom sides of the body 140 along the height direction of the body 140. The distance between the guiding surface 143 of the body 140 and the outmost ends of the blades 20 thus gradually decreases from the inner end of the body 140 towards the bulge 145, and then gradually increases from the bulge 145 towards the outer end of the body 140 adjacent the air outlet 17. That is, a minimum distance between the guiding surface 143 and the outmost ends of the blades 20 is formed between the bulge 145 and the outmost ends of the blades 20.

During assembly of the centrifugal fan, the tongue 14 is detachably mounted to the sidewall 13 via the second locking unit and the first locking unit interlocked together. The tongue 14 is first placed at a top side of the casing 10, with bottom ends of the pole portions 1421 aligned with top ends of grooves 132. Then the tongue 14 is pressed downwardly until the pole portions 1421 are wholly received in the grooves 132 respectively. Meanwhile, the bottom side of the body 140 abuts the base plate 12, and the connecting surface 144 of the body 140 attaches to the inner surface of the sidewall 13. Each cap portion 1423 protrudes out of the groove 132 with the pressing surfaces 1425 tightly contacted an outer surface of the sidewall 13. Thus, the tongue 14 is securely mounted to the sidewall 13, with the connecting surface 144 of the body 140 contacting the inner surface of the sidewall 13, and the guiding surface 143 of the body 140 away from the sidewall 13 and facing the outmost ends of the blades 20. The tongue 14 can be disassembled from the sidewall 13 by moving the body 140 upwardly when required.

During operation of the centrifugal fan, the blades 20 rotate along the counterclockwise direction to drive a radial airflow. The radial airflow can be exhausted to an outside via the air outlet 17 with higher dynamic and static pressures by passing through the air channel 18. The airflow flows first to the guiding surface 143 of the tongue 14, then along the air channel 18 and finally to the outside of the centrifugal fan via the air outlet 17. Since the bulge 145 is closer to the outmost ends of the blades 20 than the other portion of the guiding surface 143 of the tongue 14, the distance between the guiding surface 143 of the tongue 14 and the outmost ends of the blades 20 gradually increases along the rotation direction of the blades 20 from the bulge 145 towards the inner end of the body 140, thereby increasing air pressure of the airflow. Moreover, when the airflow is blowing on different points of the guiding surface 143 of the tongue 14, each blown point is a sound source that generates a narrow band noise. Because the guiding surface 143 of the tongue 14 is curved, a distance between each point of the guiding surface 143 of the body 140 and the axis X-X is different from each other, whereby the time at which each noise is generated is different. In addition, the narrow band noises have different frequencies. Therefore, the noises will not be superposed to generate a noise with a large amplitude. That is, the noise level generated by the airflow blowing on the sidewall 13 near the air outlet 17 is lessened. Furthermore, the tongue 14 is made of porous, acoustic absorbing material, which can absorb a portion of the resonant sound waves of the noises, thus reducing the amplitude of the superposed noise more effectively. The tongue 14 is detachably connected with the sidewall 13 of the casing 10, which can be formed from different materials having high sound absorption coefficients to satisfy the special needs of the centrifugal fan according to different requirements. Hence, a lower noise level is obtained to allow the centrifugal fan to operate quietly.

Figure 5:
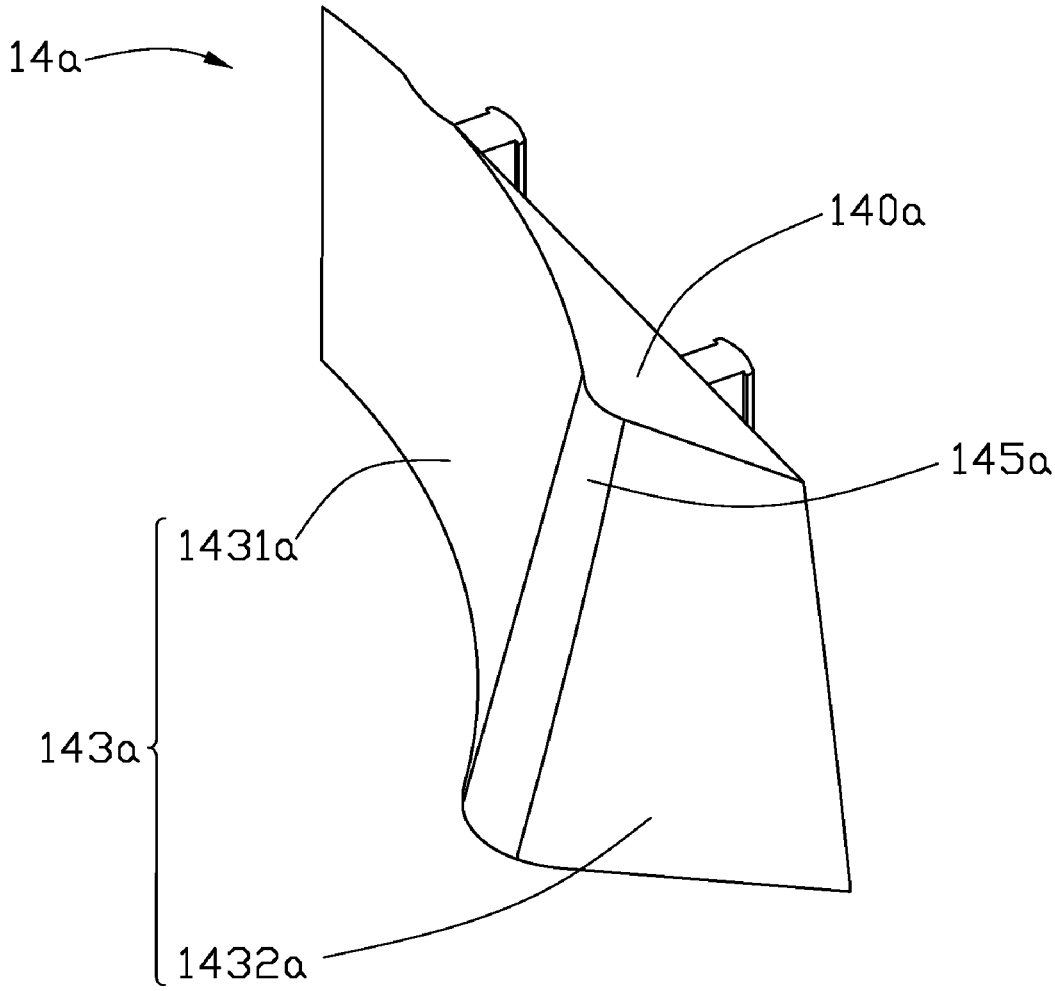
FIG. 5 is an isometric view of a tongue in accordance with a second embodiment.

FIG. 5 illustrates a tongue 14*a* according to a second embodiment, differing from the tongue 14 of the first embodiment in that a guiding surface 143*a* of a body 140*a* of the tongue 14*a* is a tapered convex surface, and the thickness of the body 140*a* increases gradually along a top-to-bottom direction of the tongue 14*a*. The guiding surface 143*a* of the tongue 14*a* includes a concave surface 1431*a* extending outwardly from the inner end of the body 140*a*, an arced angle 145*a* extending outwardly from an outer edge of the concave surface 1431*a*, and an inclined planar surface 1432*a* extending outwardly from an outer edge of the arced angle 145*a* of the body 140*a* towards the outer end of the body 140*a* adjacent the air outlet 17. The thickness of the tongue 14*a* decreases from the arced angle 145*a* towards the inner and outer ends of the body 140*a* along the lengthwise direction of the body 140*a*. The arced angle 145*a* has a thickness that increases along the top-to-bottom direction of the body 140*a*. The minimum distance between the guiding surface 143*a* of the tongue 14*a* and the outmost ends of the blades 20*a* is formed between a bottommost end of the arced angle 145*a* and the outmost ends of the blades 20.

Figure 6:
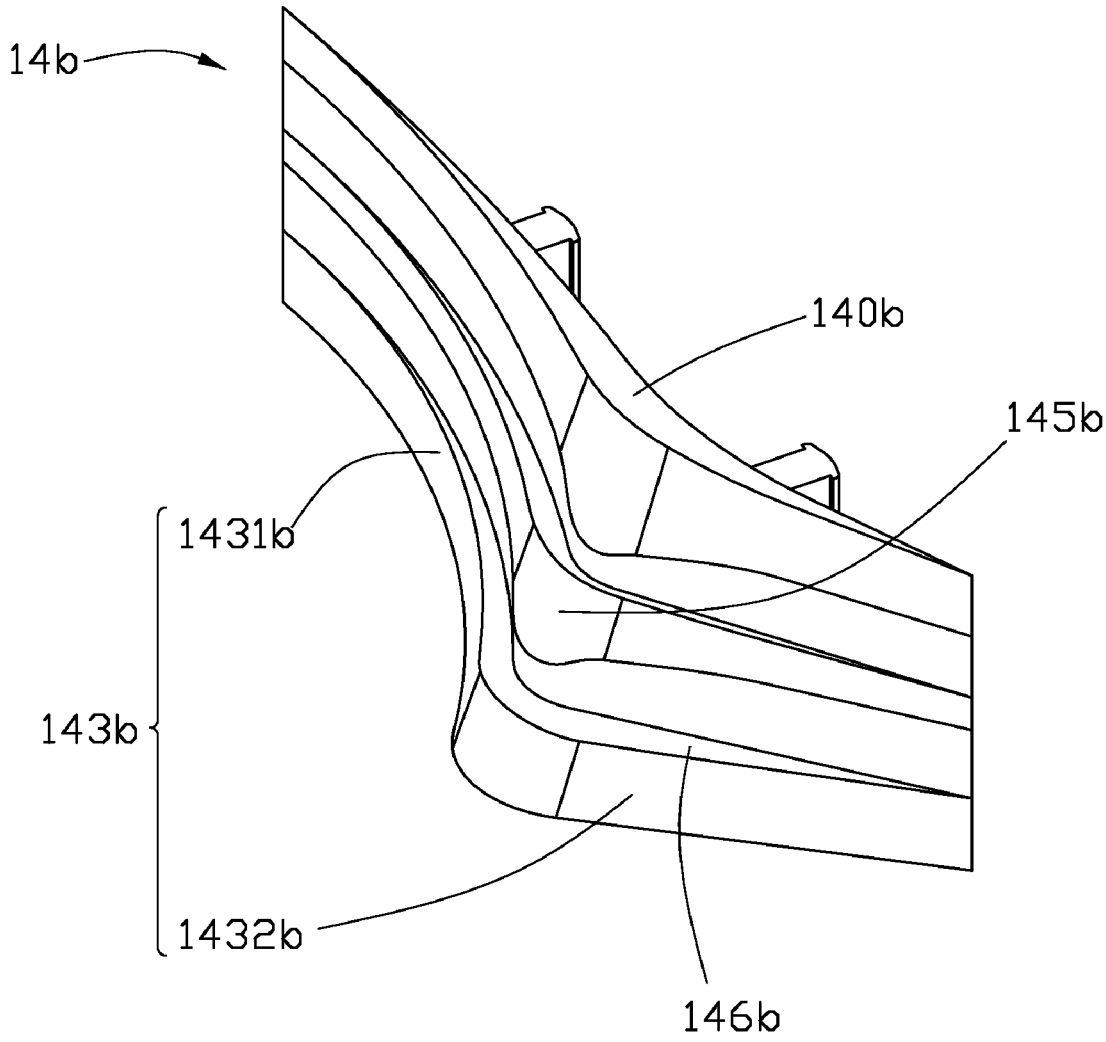
FIG. 6 is an isometric view of a tongue in accordance with a third embodiment.
Figure 7:
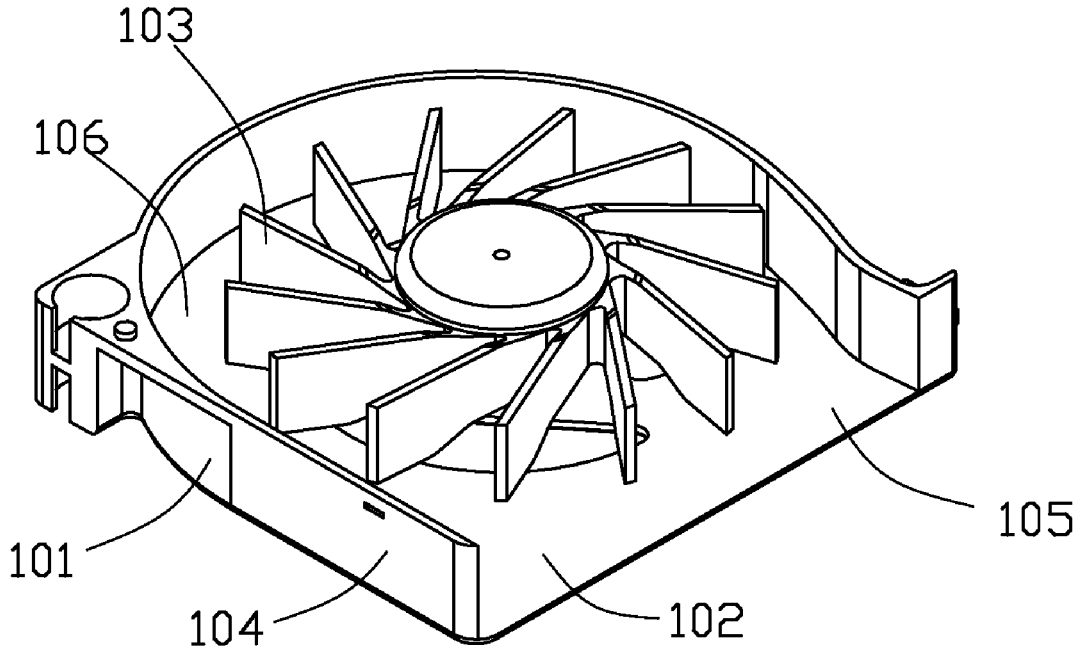
FIG. 7 (RELATED ART)
FIG. 7 is an isometric view of a related centrifugal fan.

FIG. 6 illustrates a tongue 14*b* according to a third embodiment, differing from the tongue 14*a* of the second embodiment in that a guiding surface 143*b* of a body 140*b* of the tongue 14*b* is a tapered convex surface with two slots 146*b* defined therein along the lengthwise direction of the guiding surface 143*b*. The guiding surface 143*b* of the tongue 14*b* includes three concave surfaces 1431*b* extending outwardly from the inner end of the body 140*b*, three arced angles 145*b* extending outwardly from outer edges of the three concave surfaces 1431*b*, respectively, and three inclined planar surfaces 1432*b* extending outwardly from outer edges of the three arced angles 145*b*, respectively, to the outer end of the body 140*b* adjacent the air outlet 17. Each slot 146*b* is defined between two neighboring concave surfaces 1431*b* and the corresponding two arced angles 145*b* and the corresponding two inclined planar surfaces 1432*b*. The thickness of the tongue 14*b* decreases from the arced angles 145*b* to the inner and outer ends of the body 140*b* along the lengthwise direction. In addition, the thickness of the tongue 14*b* increases along the top-to-bottom direction of the body 140*b*. The minimum distance between the guiding surface 143*b* of the tongue 14b and the outmost ends of the blades 20 is formed between a bottommost arced angle 145*b* and the outmost ends of the blades 20.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangements of parts within the principals of the invention to the full extent indicated by the broad general meaning of the terms in the which the appended claims are expressed.

What is claimed is:

1. A centrifugal fan comprising:

a plurality of blades;

a casing comprising a base plate perpendicular to a rotation axis of the blades and a sidewall extending upwardly from the base plate, the base plate and the sidewall cooperatively defining a space for receiving the blades therein, the sidewall defining an opening in a side thereof functioning as an air outlet of the centrifugal fan, an air channel being defined between outmost ends of the blades and the sidewall; and a tongue being detachably mounted to one end of the sidewall adjacent to the air outlet, the tongue comprising a guiding surface protruding towards the outmost ends of the blades;

wherein a first locking unit is formed on the one end of the sidewall adjacent to the air outlet, the tongue comprises an elongated body and a second locking unit formed on the body, the body has a connecting surface matching with an inner surface of the sidewall adjacent to the air outlet, and the second locking unit is detachably interlocked with the first locking unit to mount the tongue to the sidewall.

2. The centrifugal fan of claim 1, wherein the second locking unit comprises two pole portions protruding outwardly from the connecting surface of the body and two cap portions formed on distal sides of the pole portions respectively, the first locking unit comprising two grooves which are defined on the end of the sidewall adjacent to the air outlet, the second locking unit interlocked with the first locking unit with the pole portions being received in the grooves of sidewall, the connecting surface attached to the inner surface of the sidewall, and the cap portions abutting against an outer surface the sidewall.

3. The centrifugal fan of claim 1, wherein the guiding surface comprises a crested bulge on a middle portion thereof, a thickness of the body decreasing from the bulge towards other portions of the body.

4. The centrifugal fan of claim 1, wherein the tongue is made of porous, acoustic absorbing material.

5. The centrifugal fan of claim 4, wherein the tongue is made of one of foamed plastic, glass wool and fibers.

6. The centrifugal fan of claim 1, wherein the guiding surface comprises a concave surface extending outwardly from an inner end of the body in the space, an arced angle extending outwardly from an outer edge of the concave surface, and an inclined planar surface extending outwardly from an outer edge of the arced angle.

7. The centrifugal fan of claim 6, wherein a thickness of the body decreases from the arced angle towards the two ends of the body along a lengthwise direction of the body, and a thickness of the arced angle increases along a top-to-bottom direction of the body.

8. The centrifugal fan of claim 1, wherein the guiding surface comprises three concave surfaces extending outwardly from an inner end of the body in the space, three arced angles extending outwardly from outer edges of the three concave surfaces, respectively, and three inclined planar surfaces extending outwardly from outer edges of the three arced angles, respectively, to an outer end of the body adjacent to the air outlet, a slot being defined between each two neighboring concave surfaces and corresponding two neighboring arced angles and corresponding two neighboring inclined planar surfaces.

9. The centrifugal fan of claim 8, wherein a thickness of the body decreases from each of the arced angles towards the inner and outer ends of the body along a lengthwise direction of the body, and increases along a top-to-bottom direction of the body.

10. A centrifugal fan comprising:

a plurality of blades;

a casing comprising a base plate perpendicular to a rotation axis of the blades and a sidewall extending perpendicularly and upwardly from the base plate, the base plate and the sidewall cooperatively defining a space for receiving the blades therein, the sidewall defining an opening in a side thereof for functioning as an air outlet of the centrifugal fan, a first locking unit being formed in one end of the sidewall adjacent to the air outlet, and an air channel being defined between outmost ends of the blades and the sidewall; and a tongue comprising an elongated body having a guiding surface protruding towards the outmost ends of the blades and a second locking unit formed on the body, the second locking unit being detachably interlocked with the first locking unit to mount the tongue to the sidewall, a distance between the guiding surface and the outmost ends of the blades decreasing gradually from an inner end of the body in the space towards a middle portion of the body, and then increasing gradually from the middle portion of the body towards an outer end of the body adjacent to the air outlet.

11. The centrifugal fan of claim 10, wherein the first locking unit comprises two grooves defined in the end of the sidewall adjacent to the air outlet, the second locking unit comprising two pole portions protruding outwardly from a connecting surface of the body and two cap portions formed on distal sides of the pole portions respectively, the first locking unit and the second locking unit interlocked together with the pole portions being received in the grooves respectively, the connecting surface of the body attached to an inner surface of the sidewall, and the two cap portions abutting against an outer surface the sidewall.

12. The centrifugal fan of claim 10, wherein the tongue is made of porous, acoustic absorbing material.

13. The centrifugal fan of claim 10, wherein a thickness of the body decreases gradually from the middle portion of the body to the inner and outer ends of the body along a lengthwise direction thereof.

14. The centrifugal fan of claim 13, wherein the thickness of the middle portion of the body increases gradually along a top-to-bottom direction of the body, a minimum distance between the guiding surface and the outmost ends of the blades being formed between a bottommost end of the middle portion of the body and the outmost ends of the blades.

* * * * *